US005990637A

United States Patent [19]

Cho

[11] Patent Number: 5,990,637

[45] Date of Patent: Nov. 23, 1999

[54] DYNAMIC 4 POLAR ELECTRODE SYSTEM IN PRE-FOCUSING ELECTRODE IN ELECTRON GUN FOR COLOR CATHODE RAY TUBE

[75] Inventor: Sung Ho Cho, Kumi-si, Rep. of Korea

[73] Assignee: LG Electronics, Inc., Rep. of Korea

[21] Appl. No.: 08/826,757

[22] Filed: Mar. 24, 1997

[30] Foreign Application Priority Data

Mar. 22, 1996 [KR] Rep. of Korea ..... 96/7944
May 15, 1996 [KR] Rep. of Korea ..... 96/16132

[51] Int. Cl.[6] ..... G09G 1/04; H01J 29/50

[52] U.S. Cl. ..... 315/382; 313/414

[58] Field of Search ..... 315/14, 382; 313/414

[56] References Cited

U.S. PATENT DOCUMENTS

| | | | |
|---|---|---|---|
| 5,164,640 | 11/1992 | Son et al. | 315/382 |
| 5,347,202 | 9/1994 | Stil | 315/382 |
| 5,384,512 | 1/1995 | Kamohara et al. | 313/414 |
| 5,404,071 | 4/1995 | Son | 313/414 |
| 5,539,285 | 7/1996 | Iguchi et al. | 315/382 |

*Primary Examiner*—Gregory C. Issing

*Attorney, Agent, or Firm*—Fish & Richardson P.C.

[57] ABSTRACT

A pre-focus electrode system in an electron gun for a color cathode ray tubes disclosed, the color cathode ray tube including, in successive arrangement, a three electrode part having a plurality of cathodes each for emitting electron beams, a control electrode for controlling emission of the electron beams, an accelerating electrode for accelerating the electron beams, at least two pre-focus electrodes for pre-focusing the electron beams, and a focusing electrode and an anode for forming a main lens for focusing the electron beams on a screen. The focusing electrode has two electrodes provided by dividing the focusing electrode into two to form a first dynamic four polar lens part with one of the two electrode applied of a static voltage and the other electrode applied of a dynamic voltage synchronous to a deflection current. The dynamic four polar electrode system includes at least two sub pre-focus electrodes provided by dividing one of the pre-focus electrodes on a screen side, at least one of the sub pre-focus electrodes having electron beam pass-through holes with different horizontal and vertical sides and at least one of the sub pre-focus electrodes has a dynamic voltage applied to it causing at least one dynamic four polar lens part to be formed between the sub pre-focus electrodes.

23 Claims, 6 Drawing Sheets

DYNAMIC 4 POLAR ELECTRODE SYSTEM IN PRE-FOCUSING ELECTRODE IN ELECTRON GUN FOR COLOR CATHODE RAY TUBE

BACKGROUND OF THE INVENTION

1. Field of the Invention

The present invention relates to an electron gun for cathode ray tubes and, more particularly, to a dynamic 4 polar electrode system in a pre-focusing electrode in an electron gun for cathode ray tubes, which can correct a horizontal focus deterioration and vertical moiré of electron beams in a periphery of the screen.

2. Discussion of the Related Arts

In the prior art, respective electrodes of a in-line electron gun of a color cathode ray tube are sequentially spaced certain distances apart from a cathode in a direction of the screen vertical to a path of the electron beam. This permits the intensity of the electron beam emitted from each of the cathodes to be controlled by a bias voltage applied to each of the electrodes before arrival to the screen.

FIG. 1 illustrates a section of a general color cathode ray tube that includes a panel 1 forming a front part of the cathode ray tube, a funnel 2 having a front side fusion welded to the back of the panel 1 and backwardly converged, a neck part 3 formed at an end of the backwardly converge of the funnel. There are three cathodes 4 in an electron gun sealed in the neck part 3 arranged in-line horizontally for emitting thermal electron beams. The electron gun includes, sequentially starting from the cathodes towards the screen., a first electrode for controlling the electron beams, i.e., a controlling electrode 5, a second electrode for accelerating the electron beams, i.e., an accelerating electrode 6, third and fourth electrodes for pre-focusing the electron beams, i.e., pre-focusing electrodes 7 and 8, a fifth electrode having a dynamic four polar electrode part for focusing and correcting the electron beams, i.e., a focusing electrode 9, and a sixth electrodes interacting with the focusing electrode for forming a main lens and finally accelerating the electron beams, i.e., an anode 10. The electrodes are fixed in place by bead glass(not shown). There is a shield cup 11 disposed at one end of the anode 10, which faces the screen for prevention of electronic interference to the electron beams 12. Shield springs 13 fixed to the shield cup 11 are in contact with the graphite coated on inside surface of the funnel 2, thereby electrically connected to a cavity cap(not shown) on outer surface of the funnel 2. Each of the cathodes 4 is applied a voltage through a stem pin 14 one end of which is connected to respective cathode 4 and the other end is projected out of the neck part 3.

In order to compensate for the difference of thermal electron beam amounts emitted from each of the cathodes 4 caused by minute assembly errors between the controlling electrode 5 and the accelerating electrode 6 in assembly cathodes 4, each of the cathode is applied a voltage slightly different from the other. The controlling electrode 5 is grounded, a low voltage of 300~1000 V is applied to the accelerating electrode 6 and the fourth electrode 8 and a high voltage Eb of 27,000 V is applied to anode 10. The third electrode 7 and a first focusing electrode 91 adjacent to the fourth electrode 8 of the focusing electrode 9 which is divided into two are applied a static voltage Vsf from an intermediate voltage of 7000 V. The second focusing electrode 92 adjacent to the anode 10 is applied a dynamic voltage Vdf synchronous to a deflecting current and about 1000 V higher than the voltage to the first focusing electrode 91.

Accordingly upon application of currents to each of the cathodes 4 through the stem pins 14 on the electron gun for the conventional color cathode ray tube, a heater 15 in each of the cathodes 4 is heated to emit a electron beam from a surface of the cathode 4. The voltage on the accelerating electrode 6 accelerates the electron beams towards the panel, the pre-focusing electrodes 7 and 8 pre-focus the electron beams, and the focusing electrode 9 and the anode 10 finally focus and accelerate the electron beams. Thereafter, deflecting yokes 16 on outer circumference of the neck 5 at a transition of the panel 2 and the neck 5 deflects the electron beams to respective regions of the panel 1, to collide on a fluorescent surface 18 coated inside of the panel 1 through a color selective electron beam passing hole in a shadow mask 17 disposed on the inner side of the panel, thereby forming a pixel.

The electron beams 12 travelling along the path mentioned above are set so that they can make an exact convergence on the central portion of the panel 1 in case the electron beams are not deflected. However, in case the electron beams are deflected, the convergence of the electron beams can be mismatched because, in general, of a difference of the curvature between central and peripheral portions of the panel and the in-line configuration of the electron gun, which causes the electron beams 12 emitted from each of the cathodes to travel a distance farther than a distance to the central portion of the screen when the electron beams 12 are deflected to a periphery of the screen. In general, this mismatch of the convergence can be corrected by devising the deflecting yokes 16 which deflect the electron beams to form a nonuniform magnetic field.

The nonuniform magnetic field is a magnetic field consisting of a pin cushion type magnetic field formed by a saddle type horizontal winding of coil, of the coil wound on the deflecting yoke, and a barrel type magnetic field formed by a troidal vertical winding of coil. The pin cushion type magnetic field deflects and slightly focuses the electron beams in the horizontal direction and the barrel type magnetic field deflects and focuses the electron beams in the vertical direction. However, the horizontal slight focusing capability of the pin cushion type magnetic field and the vertical focusing capability of the barrel type magnetic field combine in expanding the electron beams excessively in the horizontal direction and focusing the electron beams excessively in the vertical direction in a periphery of the screen. This results in formation of a high density, transversely elongated core and a vertical haze which is a low density dispersion of an image. Such excessive horizontal expansion and vertical haze are corrected by a first dynamic four polar electrode part A provided in the first and second focusing electrode 91 and 92.

This will be explained in more detail with reference to FIGS. 2A and 2B. FIG. 2A illustrates a cross section of an in-line type dynamic electron gun for a color cathode ray tube having the first dynamic four polar electrode part in the focusing electrodes, and FIG. 2A illustrates a section across I—I line in FIG. 2B.

In FIGS. 2A and 2B, the first dynamic four polar electrode part includes three electron beam pass-through holes 921 formed in the second focusing electrode 92 at cathode side, horizontal partition walls 922 on upper and lower sides of the three electron beam pass-through holes 921, a rim 912 having an electron beam pass-through hole 911 for passing the three electron beams in common formed on the first focusing electrode 91 at the screen side, and an inner electrode 93 having three electron beam pass-through holes 931 for passing the three electron beams inside of the first focusing electrode 91. Burring parts 923 and 933 are provided around the electron beam pass-through hole 931 in the inner electrode 93 and the electron beam pass-through hole 921 at the cathode side of the second focusing electrode 92. The burring parts 923 and 933 are projected to the cathodes 4 and the screen in directions opposite to each other. As shown in FIG. 2B, the horizontal partition walls 922 has curved parts 922A at upper and lower sides of the electron beam pass-through holes 921 of the second focusing electrode 92, and straightened parts 922B are at the parts of connecting the electron beam pass-through holes 921 and outer sides of the electron beam pass-through holes 921.

The first focusing electrode 91 is applied a static voltage Vsf of 7000 V and the second focusing lens 92 is applied a dynamic voltage Vdf about 1000 V higher than the static voltage to the first focusing electrode 91 and synchronous to a deflection signal depending on an extent of deflection of the electron beams. The four polar dynamic lens is formed between the first and second focusing electrodes 91 and 92 by a voltage difference of the static voltage Vsf to the first 10 focusing electrode 91 and the dynamic voltage Vdf to the second focusing electrode 92. Particularly, since the horizontal partition walls 922 are provided at upper and lower sides of the second focusing electrode 92 to which a higher voltage is applied to focus the electron beams slightly, a vertical focusing force of the electron beams in the periphery of the screen is weakened because a vertical slight focusing force for the electron beams acts intensely. This eliminates haze and improves resolution in the periphery of the screen as shown in FIG. 3B because the intense vertical slight focusing force compensate for the excessive focusing caused by the nonuniform magnetic field of the deflection yokes.

However, since the first dynamic four polar electrode part synchronous to the dynamic voltage of the deflection yokes has been designed taking only the deterioration of the electron beams caused by the nonuniform magnetic field of the deflection yokes into consideration, but not the relationship of the pre-focus lens, the pre-focus electrode can not provide an optimal cross-over point diameter and pre-focusing angle to the main lens. Accordingly, the horizontal focusing deterioration caused by horizontally enlarged and vertically reduced spot in a periphery of the screen can not be eliminated completely and a limitation in correction of the deterioration occurs. In addition because of the particular reduction of the vertical spot size in a low current range in deflection of the beams, moiré is caused in a vertical direction by a deflection current that further deteriorates the resolution.

SUMMARY OF THE INVENTION

Accordingly, the present invention is directed to a dynamic four polar electrode system in a pre-focus electrode in an electron gun for a cathode ray tube that substantially obviates one or more of the problems due to limitations and disadvantages of the related art.

This invention provides a dynamic four polar electrode system in a pre-focus electrode of an electron gun for a cathode ray tube, which can provide an optimal cross-over point diameter and an optimal pre-focus angle to a main lens according to an extent of deflection of electron beams when the electron beams are deflected to a periphery of a screen.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a dynamic four polar electrode system in pre-focusing electrodes of an electron gun for a color cathode ray tube, the color cathode ray tube including in successive arrangement, a three electrode part having a plurality of cathodes each for emitting electron beams, a control electrode for controlling emission of the electron beams, an accelerating electrode, for accelerating the electron beams at least two pre-focus electrodes for pre-focusing the electron beams, and a focusing electrode and an anode for forming a main lens for focusing the electron beams on a screen. The focusing electrode has two electrodes provided by dividing the focusing electrode into two to form a first dynamic four polar lens part with one of the two electrode applied of a static voltage and the other electrode applied of a dynamic voltage synchronous to a deflection current. The dynamic four polar electrode system includes at least two sub pre-focus electrodes provided by dividing one of the pre-focus electrodes on a screen side, at least one of the sub pre-focus electrodes having electron beam pass-through holes with different horizontal and vertical sides and at least one of the sub pre-focus electrodes has a dynamic voltage, applied to it causing at least one dynamic four polar lens part to be formed between the sub pre-focus electrodes.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention examples of which are illustrated in the accompanying drawings.

All systems of embodiments of the present invention are based on an electron gun having at least two pre-focus electrodes and a first dynamic four polar lens formed between a two divisional focusing electrode.

Figure 1:
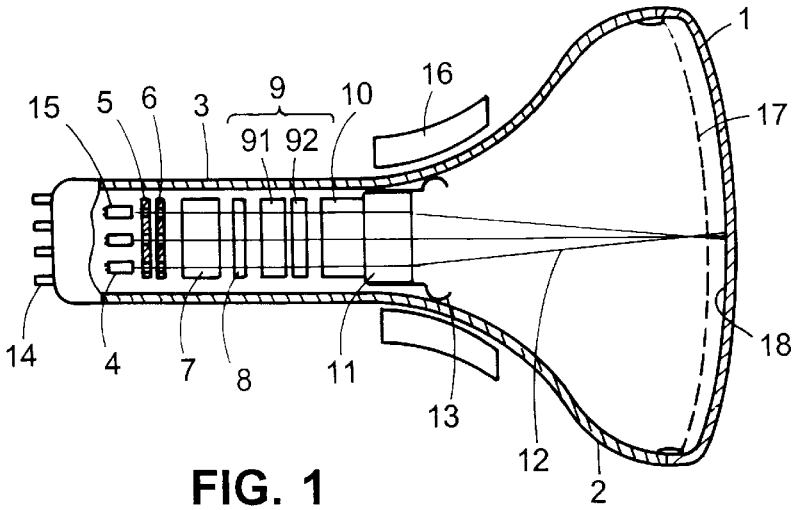
FIG. 1 PRIOR ART
FIG. 1 illustrates a cross sectional view of a conventional color cathode ray tube.
Figure 2A:
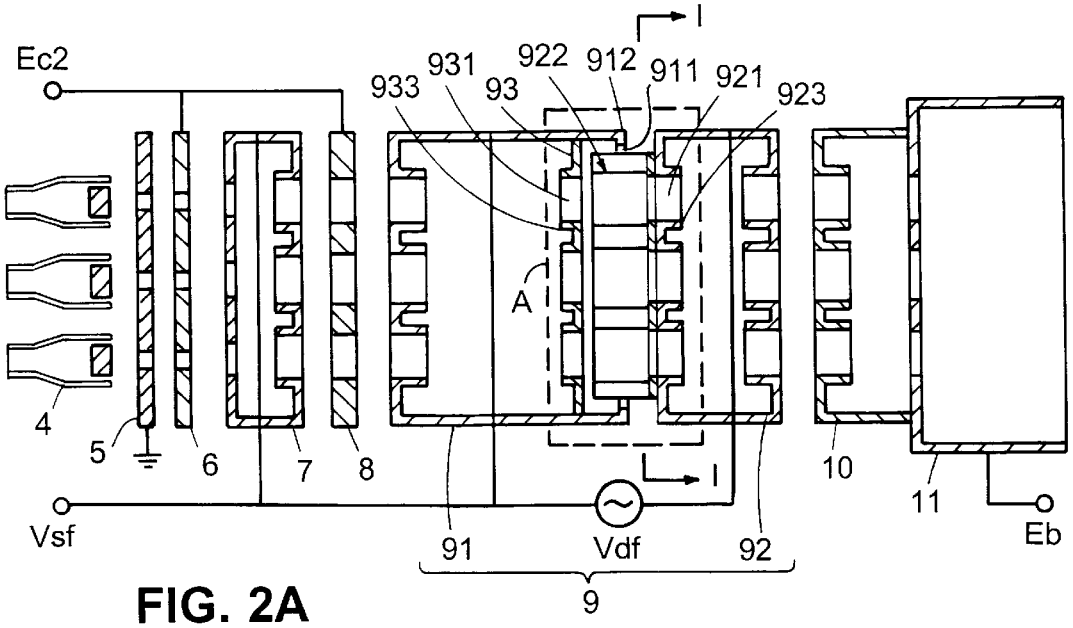
FIG. 2A PRIOR ART
FIG. 2A illustrates an cross sectional view of the in-line type electron gun having a first dynamic four polar electrode part formed in the focusing electrode shown in FIG. 1.
Figure 2B:
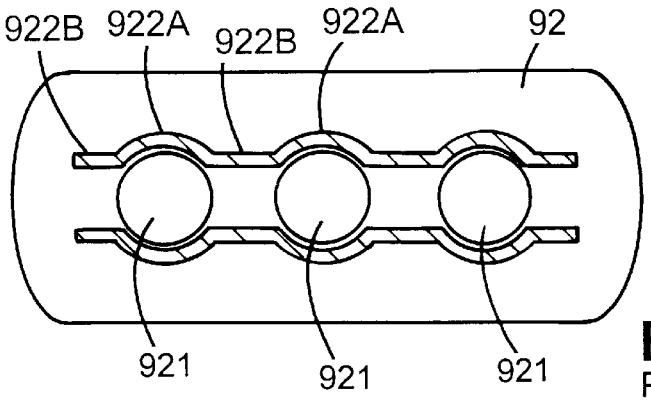
FIG. 2B PRIOR ART
FIG. 2B illustrates a section of the second focusing electrode across line I—I in FIG. 2A.
Figure 4:
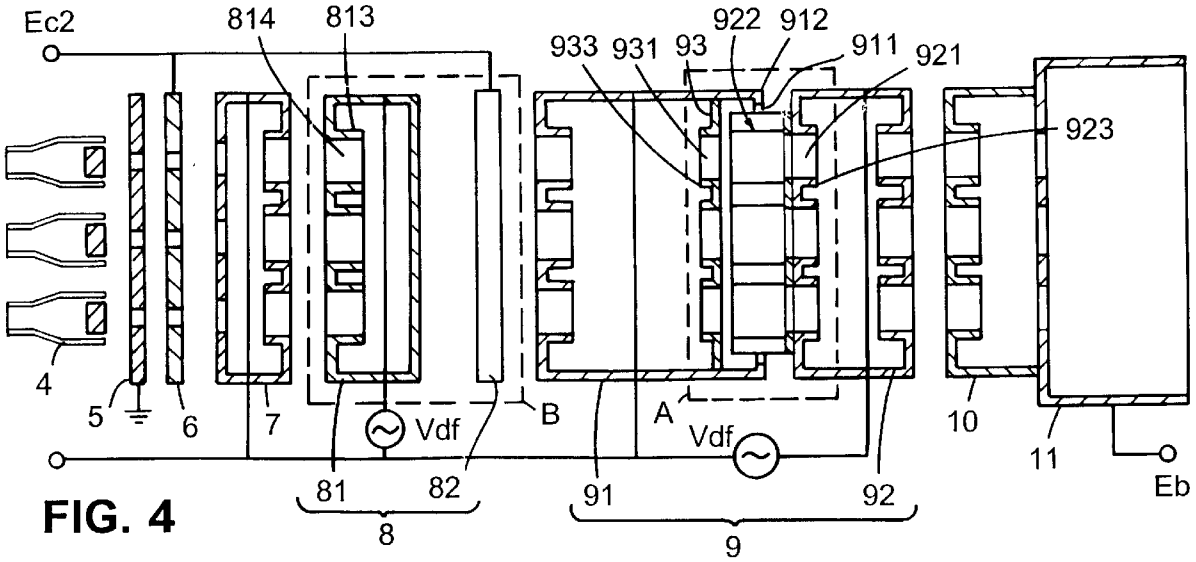
FIGS. 4, 5, 6 and 7 illustrate cross sectional views of an in-line type electron gun for a color cathode ray tube each showing a dynamic four polar electrode system in a pre-focus electrode and voltages applied thereto in accordance with first, second, third and fourth embodiments of the present invention.

FIGS. 4 illustrates a cross sectional view of an in-line type electron gun for a color cathode ray tube showing a dynamic four polar electrode system in a two-divisional pre-focus electrode and voltages applied in accordance with a first embodiment of the present invention. The same reference numbers are used in FIG. 4 as in the prior art system of FIG. 2A for identical parts.

Referring to FIG. 4, the "A" part in a dotted rectangular is a conventional first dynamic four polar electrode part and the "B" part in another dotted rectangular is a second dynamic four polar electrode part in accordance with the present invention.

The second dynamic four polar electrode part includes a cylindrical pre-focus electrode 81 having the pre-focus electrode 8 divided into two on the screen side, i.e., adjacent to the first focusing electrode 91 of at least the two pre-focus electrodes 7 and 8, and a plate type second pre-focus electrode 82. The first pre-focus electrode has three electron beam pass-through holes 814 formed on the cathode 4 side, burring parts 813 each projected toward the screen around the electron beam pass-through holes 814, and three electron beam pass-through holes 811 on the screen side. The second pre-focus electrode 82 has three electron beam pass-through holes 821.

The first pre-focus electrode 81 is applied a dynamic voltage Vdf synchronous to a deflection current of the second focusing electrode 92 and the second pre-focus electrode 82 is applied a voltage Ec2 to the accelerating electrode 6. The second dynamic four polar lens is formed by a voltage difference between the two electrodes between the first pre-focus electrode 81 and the second pre-focus electrode 82.

Herein, since the behavior of electron beam is influenced by, not only the pre-focus lenses themselves, but also a form of the electron beam pass-through hole, the forms of the electron beam pass-through holes 811 and 821 in the first and second pre-focus electrodes explained below can be appropriately selected according to the behavior of the beams. FIGS. 10A, 10B, 10C, 10D, 10F and 10G illustrate various forms of electron beam pass-through holes applicable to the second dynamic four polar lens part in accordance with the present invention. Basically, in the first embodiment of the present invention, the electron beam pass-through holes 811 in the first pre-focus electrode 81 have a vertically elongated form, and the electron beam pass-through holes 821 in the second pre-focus electrode 82 have a horizontally elongated form, with the following alternatives.

ALTERNATIVE 1

Figure 10A:
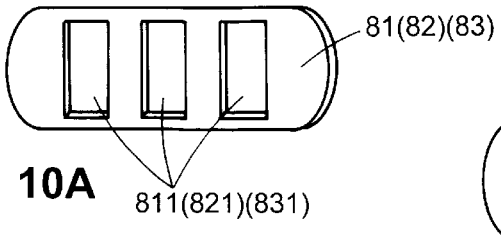
Figure 10E:
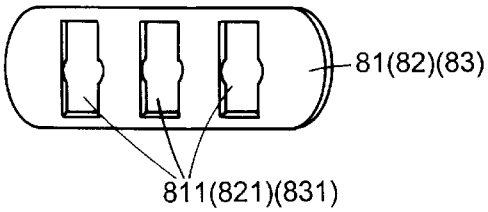
Figure 10B:
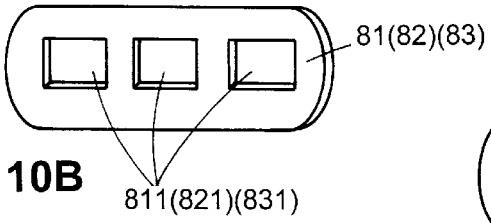

The electron beam pass-through holes 811 in the first pre-focus electrode 81 have a vertically elongated rectangular form with a longer height than a width as shown in FIG. 10A, and the electron beam pass-through holes 821 in the second pre-focus electrode 82 have a horizontally elongated rectangular form with a longer width than a height as shown in FIG. 10B.

ALTERNATIVE 2

Figure 10F:
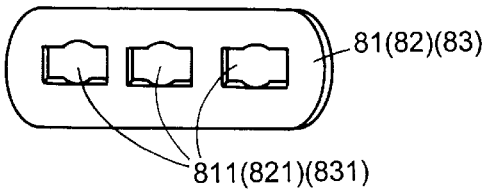
Figure 10C:
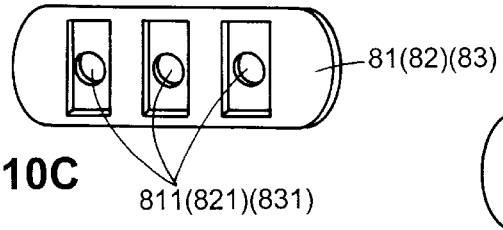
Figure 10G:
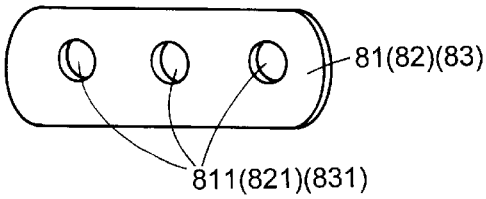
Figure 10D:
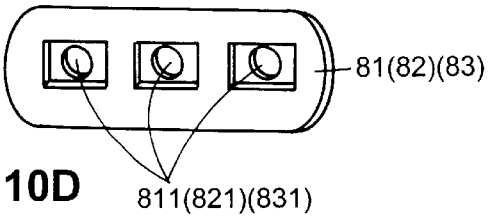

The electron beam pass-through holes 811 in the first pre-focus electrode 81 have a circular form formed in a vertically elongated recess as shown in FIG. 10C, and the electron beam pass-through holes 821 in the second pre-focus electrode 82 have a circular form formed in a horizontally elongated rectangular recess as shown in FIG. 10D. The two recesses are arranged to face each other for enhancing versatility of the electron beam correction by means of the asymmetry of the arrangement.

ALTERNATIVE 3

The electron beam pass-through holes 811 in the first pre-focus electrode 81 have a vertically elongated key hole form with a vertically elongated rectangular hole with a circular hole in the middle as shown in FIG. 10E, and the electron beam pass-through holes 821 in the second pre-focus electrode 82 have a horizontally elongated key hole form with a horizontally elongated rectangular hole with a circular hole in the middle as shown in FIG. 10F.

All the forms of the electron beam pass-through holes 821 in the second pre-focus electrode suggested in the alternatives 1, 2 and 3 may be replaced with circular holes as shown in FIG. 10G.

Figure 5:
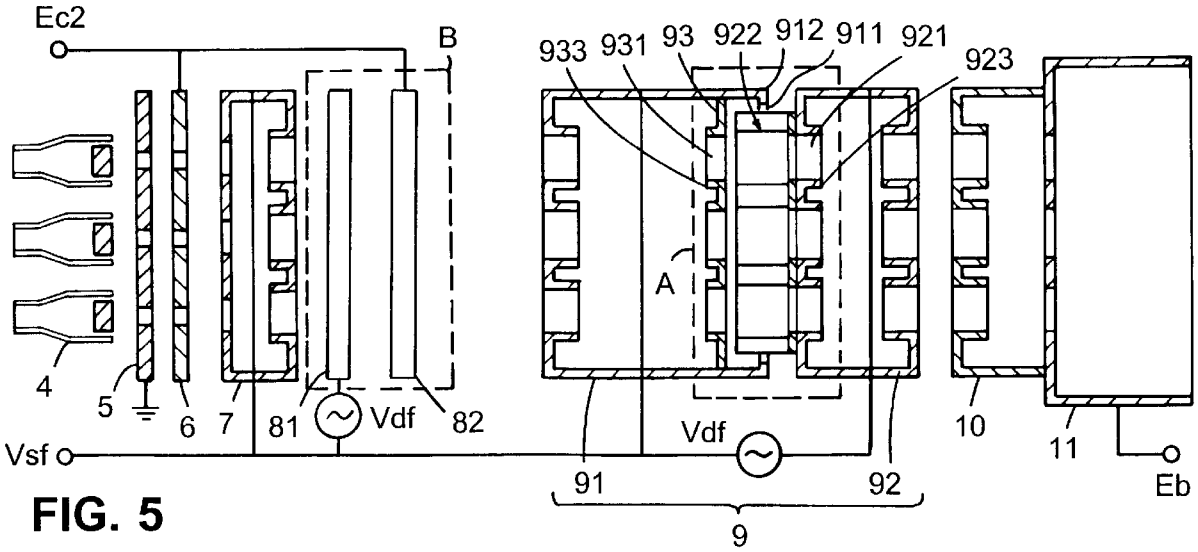
Figure 6:
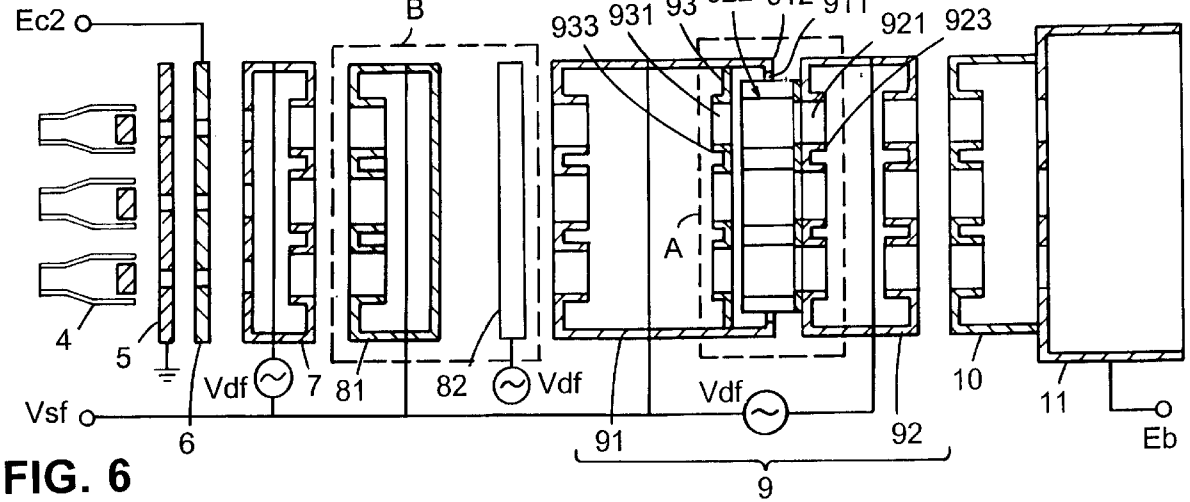
Figure 7:
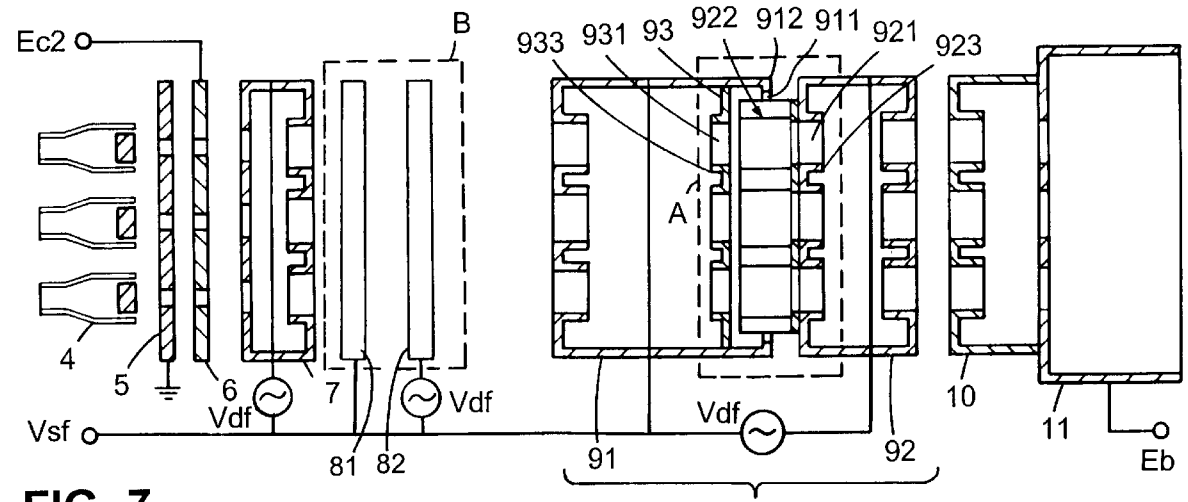

FIGS. 5, 6 and 7 illustrate cross sectional views of an in-line type electron gun for a color cathode ray tube each showing a dynamic four polar electrode part in a two-divisional pre-focus electrode and voltages applied in accordance with second, third and fourth embodiments of the present invention, wherein parts identical to the parts explained in the first embodiment will have the same reference numbers.

Referring to FIG. 5, the second embodiment is different from the first embodiment only in that the form of the first pre-focus electrode of the second embodiment is not the cylindrical type, but a plate type.

The configurations of the third and fourth embodiments are the same with the first and second embodiments, but different in application of the voltages, respectively; the first pre-focus electrode 81 is applied of the static voltage Vsf, the low voltage to the first focusing electrode 91, the second pre-focus electrode 82 is applied of the dynamic voltage, the high voltage to the second focusing electrode 92, and the pre-focusing electrode, the third electrode 7, already existed, not divided and arranged between the accelerating electrode 6 and the first pre-focus electrode 81 is also applied of the dynamic voltage Vdf.

As such voltage application systems are opposite to the voltage application systems applied to the first and second pre-focus electrodes 81 and 82 in the first and second embodiments respectively, in order to obtain the same effect with the second dynamic four polar lenses, the forms of the electron beam pass-through holes 811 and 821 arranged oppositely in the first and second pre-focus electrodes 81 and 82 respectively are opposite to the forms of the electron beam pass-through holes 811 and 821 in the first and second embodiments, respectively; basically, the electron beam pass-through holes 811 formed at one side of the first pre-focus electrode 81 opposite to the second pre-focus electrode 82 have a horizontally elongated forms, and the electron beam pass-through holes 821 in the second pre-focus electrode 82 have a vertically elongated forms, with the following alternatives.

ALTERNATIVE 1

The forms of the electron beam pass-through holes 811 in the first pre-focus electrode 81 are horizontally elongated rectangles as shown in FIG. 10B, and the forms of the electron beam pass-through holes 821 in the second pre-focus electrode 82 are vertically elongated rectangles as shown in FIG. 10A.

ALTERNATIVE 2

The forms of the electron beam pass-through holes 811 in the first pre-focus electrode 81 are circular each formed in a horizontally elongated rectangular recess as shown in FIG. 10D, and the forms of the electron beam pass-through holes 821 in the second pre-focus electrode 82 are circular each formed in a vertically elongated recess as shown in FIG. 10C. The two recesses are arranged to face each other for enhancing versatility in the electron beam correction by means of the asymmetry of the arrangement.

ALTERNATIVE 3

The forms of the electron beam pass-through holes 811 in the first pre-focus electrode 81 are horizontally elongated key holes each with a horizontally elongated rectangular hole with a circular hole in the middle as shown in FIG. 10F, and the forms of the electron beam pass-through holes 821 in the second pre-focus electrode 82 are vertically elongated key holes each with a vertically elongated rectangular hole with a circular hole in the middle as shown in FIG. 10E.

All the forms of the electron beam pass-through holes 811 in the first pre-focus electrode 81 suggested in the alternatives 1, 2 and 3 may be replaced with circular holes as shown in FIG. 10G. The dynamic four polar electrode systems in the pre-focus electrodes of the first to fourth embodiments functions in the following manner. In the first and second embodiments of the present invention, the first pre-focus electrode 81 has the vertically elongated electron beam pass-through holes 811 and applies a high voltage that slightly focuses the electron beams and the second pre-focus electrode 82 has the horizontally elongated electron beam pass-through holes 821 and applies a low voltage which intensely focuses the electron beams, an asymmetrical second dynamic four polar lens is formed between the first and second pre-focus electrodes 81 and 82. Therefore, since the electron beams passing through these electron beam pass-through holes experience a horizontal focusing intensity lower than a vertical focusing intensity, the spot sizes of the electron beam passed through the main lens and the shadow mask and formed on the fluorescent surface are reduced in the horizontal direction and enlarged in the vertical direction.

In the third and fourth embodiment, the first pre-focus electrode 81 has the horizontally elongated electron beam pass-through holes 811 and applies a low voltage which intensely focuses the electron beams. The second pre-focus electrode 82 has the vertically elongated electron beam pass-through holes 821 and applies a low voltage which intensely focuses the electron beams together with the already existing undivided pre-focus electrode, i.e., the third electrode 7, an electron beam correcting effect like the first and second embodiments can be obtained. Moreover, as the third electrode 7 is applied of the dynamic voltage synchronous to the deflection current, an effect of formation of a third dynamic four polar lens between the accelerating electrode 6 and the third electrode 7 can be obtained, which provides an additional advantage of obtaining an electron beam correcting effect that is better than the first and second embodiments.

As, in the first and second embodiments, the electron beams pass-through holes 821 in the second pre-focus electrode 82 may be circular, and, in the third and fourth embodiments, the electron beams pass-through holes 811 in the second pre-focus electrode 81 may be circular, with a reduction of an extent of asymmetry between the electron beam pass-through holes of the first pre-focus electrode 81 and the second pre-focus electrode 82, the action of the second dynamic four polar lens is also weakened. Accordingly, in case it is intended to reduce an extent of electron beam correction, the circular electron beam pass-through holes 811 and 821 may be applied to the first and second pre-focus electrodes 81 and 82.

In the first and third embodiments, by forming the first pre-focus electrode 81 cylindrical, the intensities of the second dynamic four polar lens of the second dynamic four polar electrode B can be formed higher than a case when the first pre-focus electrode 81 is plate type, which is a configuration in which an influence to the second dynamic four polar lens from a pre-focus lens formed between the third electrode 7, which is a pre-focus electrode on the cathode side 4, and the first pre-focus electrode 81 can be reduced, with an advantage that causes of variation of the second dynamic four polar lens can be reduced.

In the second and fourth embodiments, the first pre-focus electrode 81 may be of the plate type, which is advantageous in manufacture.

A too intense asymmetrical second dynamic four polar lens, which occurs due to a high voltage difference between the first and second pre-focus electrodes 81 and 82 coming from application of about 300~1000 V of the voltage Ec2 of the accelerating electrode to the second pre-focus electrode 82 and a dynamic voltage of about 6000~10,000 V to the first pre-focus electrode 81, may cause a difficulty in compensation of an optimal cross-over point position. In such a case, as in the third and fourth embodiments, a constant static voltage Vsf is applied to the first pre-focus electrode 81 and a dynamic voltage Vdf about 1000 V higher than the static voltage Vsf is applied to the second pre-focus electrode 82 and the third electrode 7, with a maximum voltage difference of about 1000 V, to form an asymmetric lens then the first and second embodiments, thereby the cross-over point diameter can be optimized.

Figure 8:
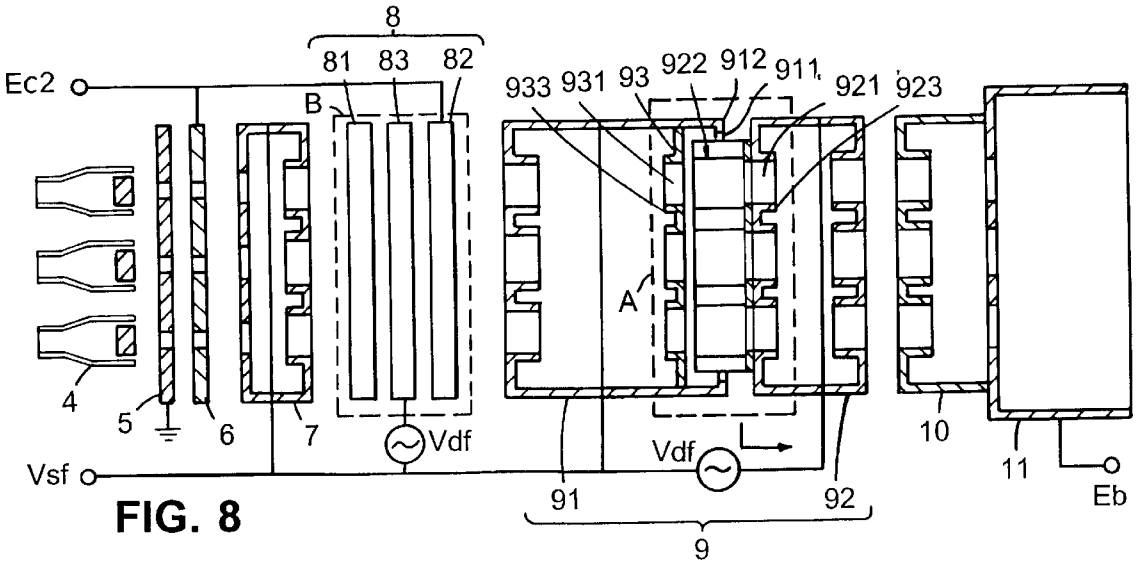
FIGS. 8 and 9 illustrate cross sectional views of an in-line type electron gun for a color cathode ray tube showing a dynamic four polar electrode system in a pre-focus electrode and voltages applied in accordance with fifth and sixth embodiments of the present invention; and, FIGS. 10A, 10B, 10C, 10D, 10F and 10G illustrate various forms of electron beam pass-through holes applicable to the dynamic four polar electrode systems in pre-focus electrodes in accordance with embodiments of the present invention.
Figure 9:
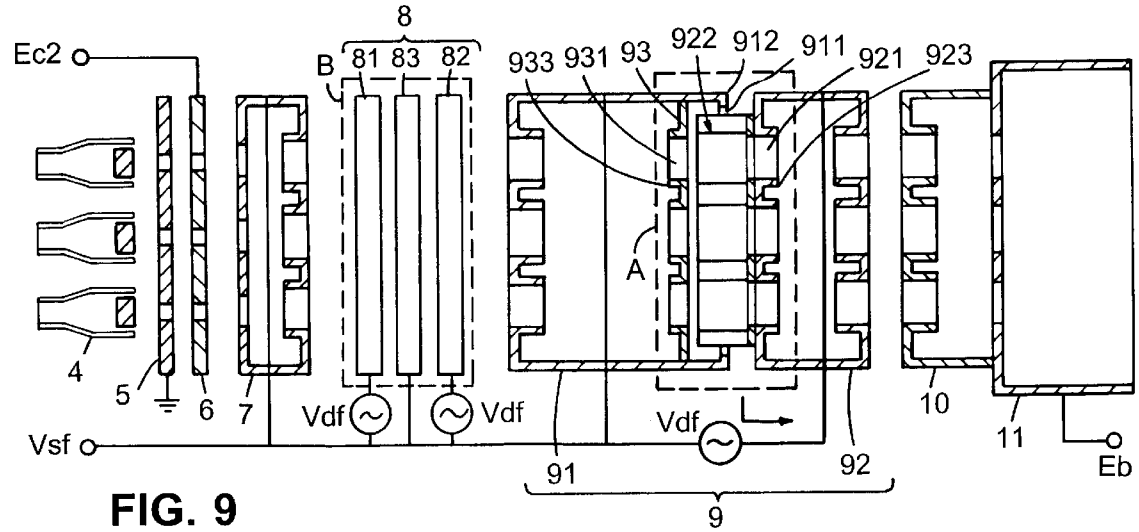

FIGS. 8 and 9 illustrate cross sectional views of an in-line type electron gun for a color cathode ray tube each showing a dynamic four polar electrode system in a three-divisional pre-focus electrode and voltages applied in accordance with fifth and sixth embodiments of the present invention respectively. In these embodiments, a pre-focus electrode 83 is between the first and second pre-focus electrodes 81 and 82 FIGS. 10A~10G which have been explained are also applicable to the fifth and sixth embodiments.

Referring to FIG. 8 showing the fifth embodiment, dynamic four polar electrode system in a pre-focus electrode of the present invention, the first and second pre-focus electrodes 81 and 82 are applied a voltage Ec2 to the accelerating electrode and the third pre-focus electrode 83 is applied a dynamic voltage Vdf to the second focusing electrode 92.

The electron beam pass-through holes in the first and second pre-focus electrodes 81 and 82 applicable to the fifth embodiment pre-focus system are the horizontally elongated type, and the electron beam pass-through holes in the third pre-focus electrodes 83 are the vertically elongated type, with the following alternatives.

ALTERNATIVE 1

The electron beam pass-through holes 811 and 821 in the first and second pre-focus electrodes 81 and 82 have horizontally elongated rectangular forms as shown in FIG. 10B, and the electron beam pass-through holes 831 in the third pre-focus electrode 83 have vertically elongated rectangular forms as shown in FIG. 10A.

ALTERNATIVE 2

The electron beam pass-through holes 811 and 821 in the first and second pre-focus electrodes 81 and 82 have circular forms each formed in a horizontally elongated rectangular recess as shown in FIG. 10D, and the electron beam pass-through holes 831 in the third pre-focus electrode 83 have circular forms each formed in a vertically elongated recess as shown in FIG. 10C. It is preferable that the two recesses in the first and second pre-focus electrodes 81 and 82 are arranged to face each other.

ALTERNATIVE 3

The electron beam pass-through holes 811 and 821 in the first and second pre-focus electrodes 81 and 82 have horizontally elongated key hole forms each with a horizontally elongated rectangular hole with a circular hole in the middle as shown in FIG. 10F, and the electron beam pass-through holes 831 in the third pre-focus electrode 83 have vertically elongated key hole forms each with a vertically elongated rectangular hole with a circular hole in the middle as shown in FIG. 10E.

All the forms of the electron beam pass-through holes 811 and 821 in the first and second pre-focus electrodes suggested in the alternatives 1, 2 and 3 may be replaced with circular holes as shown in FIG. 10G.

FIGS. 9 illustrates a cross sectional view of an in-line type electron gun for a color cathode ray tube showing three-divisional pre-focus electrode system and voltages applied in accordance with a sixth embodiment of the present invention, which is different from the fifth embodiment in terms of the power application system. That is, in order to weaken an intensity of the asymmetric second dynamic four polar lens which is weaker than the fifth embodiment, the first and second pre-focus electrode 81 and 82 are applied a dynamic voltage Vdf and the third pre-focus electrode 83 is applied a static voltage Vsf.

As such voltage application system is opposite to the voltage application system applied to the first and second pre-focus electrodes 81 and 82 in the fifth embodiment, the forms of the electron beam pass-through holes 811, 821 and 831 in the first and second pre-focus electrodes 81 and 82 and the third pre-focus electrode 83 are opposite to the forms of the electron beam pass-through holes 811 and 821 in the fifth embodiment; the electron beam pass-through holes 811 and 821 in the first and second pre-focus electrodes 81 and 82 have vertically elongated forms and the electron beam pass-through holes 831 in the third pre-focus electrode 83 have horizontally elongated forms, with the following alternatives.

ALTERNATIVE 1

The forms of the electron beam pass-through holes 811 and 821 in the first and second pre-focus electrodes 81 and 82 are vertically elongated rectangles as shown in FIG. 10A, and the forms of the electron beam pass-through holes 831 in the third pre-focus electrode 83 are horizontally elongated rectangles as shown in FIG. 10B.

ALTERNATIVE 2

The forms of the electron beam pass-through holes 811 and 821 in the first and second pre-focus electrodes 81 and 82 are circular each formed in a vertically elongated rectangular recess as shown in FIG. 10C, and the forms of the electron beam pass-through holes 831 in the third pre-focus electrode 831 are circular each formed in a horizontally elongated recess as shown in FIG. 10D. It is preferable that the two recesses in the first and second pre-focus electrodes 81 and 82 are arranged to face each other.

ALTERNATIVE 3

The forms of the electron beam pass-through holes 811 and 821 in the first and second pre-focus electrode 81 and 82 are vertically elongated key holes each with a vertically elongated rectangular hole with a circular hole in the middle as shown in FIG. 10E, and the forms of the electron beam pass-through holes 831 in the third pre-focus electrode 83 are horizontally elongated key holes each with a horizontally elongated rectangular hole with a circular hole in the middle as shown in FIG. 10F.

All the forms of the electron beam pass-through holes 831 in the third pre-focus electrode 83 suggested in the alternatives 1, 2 and 3 may be replaced with circular holes as shown in FIG. 10G.

The principle of the electron beam correction in the fifth and sixth embodiments is the same with the first to fourth embodiments, except for the sixth embodiment in which the first and second pre-focus electrodes 8 I and 82 are applied of the dynamic voltage Vdf and the third pre-focus electrode 8, is applied of the static voltage Vsf, with an advantage that third and fourth four polar lenses are formed between the accelerating electrode 6 and the first pre-focus electrode 81 and between the second pre-focus electrode 82 and the first focusing electrode 91 respectively, which provides an additional advantage in obtaining an electron beam correction effect better than the fifth embodiment.

Figure 3A:
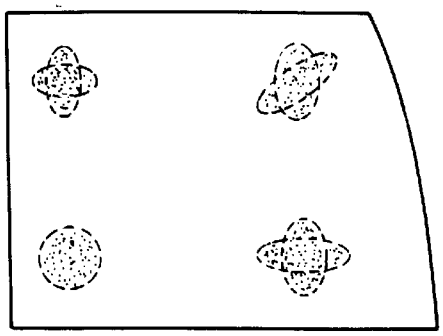
FIG. 3A illustrates exemplary distortions of electron beam spots formed on the screen when the first dynamic four polar electrode part is not provided in the focusing electrode shown in FIG. 2A.
Figure 3B:
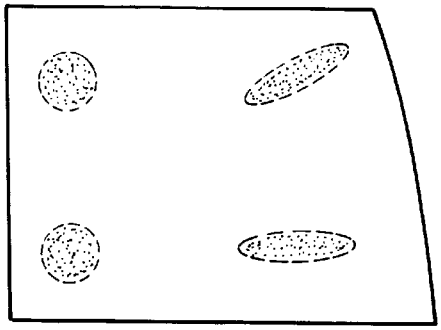
FIG. 3B illustrates exemplary corrected electron beam spots formed on the screen when the first dynamic four polar electrode part is provided in the focusing electrode shown in FIG. 2A.
Figure 3C:
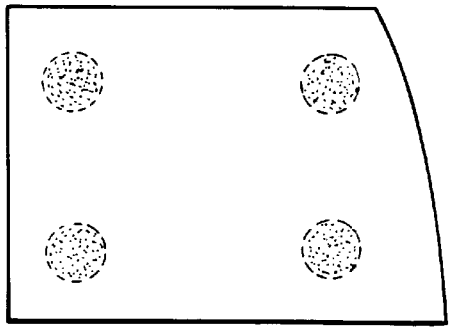
FIG. 3C illustrates electron beam spots formed on the screen by an in-line type electron gun having a dynamic four polar electrode; system in a pre-focus electrode in accordance with the embodiments of the present invention are applied thereto.

FIG. 3C illustrates exemplary electron beam spots formed on the screen by an in-line type electron gun having the dynamic four polar electrode systems in the pre-focus electrodes in accordance with the embodiments of the present invention. It can be clearly known that the deterioration of the spots are substantially improved compared to the beam spots by the conventional electron gun in which the first dynamic four polar electrode only is applied to the focusing lens.

As has been explained, by forming a second dynamic four polar electrode system in a two or three divisional pre-focus electrode on a screen side synchronous to the first dynamic four polar electrode system, the dynamic four polar electrode system of the present invention can provide an optimal pre-focusing angle, which changes the horizontal and vertical cross-over point of the electron beams that enlarges spots in the vertical direction, whereby the horizontal spot enlargement and vertical spot reduction can be compensated for, and moiré in a low current range can be prevented.

It will be apparent to those skilled in the art that various modifications and variations can be made in a dynamic four polar electrode system in a pre-focus electrode in an electron gun for a color cathode ray tube of the present invention without departing from the spirit or scope of the invention. Thus, it is intended that the present invention cover the modifications and variations of this invention provided they come within the scope of the appended claims and their equivalents.

What is claimed is:

1. A dynamic four polar electrode system in pre-focusing electrodes of an electron gun for a color cathode ray tube, the color cathode ray tube including, successively arranged:

a three electrode part having a plurality of cathodes each for emitting electron beams, a control electrode for controlling emission of the electron beams, an accelerating electrode, at least two pre-focus electrodes for pre-focusing the electron beams, a focusing electrode, and an anode for forming a main lens for focusing the electron beams on a screen, wherein the focusing electrode has two electrodes provided by dividing the focusing electrode into two to form a first dynamic four polar lens part with a static voltage applied to one of the two electrodes and a dynamic voltage synchronous to a deflection current applied to the other electrode, the dynamic four polar electrode system comprising:

at least two sub pre-focus electrodes provided by dividing one of the pre-focus electrodes on a side nearest the screen, at least one of the sub pre-focus electrodes having electron beam holes with different horizontal and vertical sides and the dynamic voltage is applied to at least one of the sub pre-focus electrodes, thereby forming at least a second dynamic four polar lens part between the sub pre-focus electrodes.

2. A dynamic four polar electrode system as claimed in claim 1, wherein the pre-focus electrodes on a screen side is divided into a first sub pre-focus electrode on a cathode side and a second sub pre-focus electrode on a screen side.

3. A dynamic electrode system as claimed in claim 2, wherein the first and second sub pre-focus electrodes are plate type each having three electron beam pass-through holes.

4. A dynamic four polar electrode system as claimed in claim 2, wherein the first sub pre-focus electrode is cylindrical and includes, a cathode side having three electron beam pass-through holes, a burring part projected toward a screen direction formed around each of the electron beam pass-through holes, and a screen side having three electron beam pass-through holes; and the second sub pre-focus electrode is a plate type having three electron beam pass-through holes.

5. A dynamic four polar electrode system as claimed in one of claims 2 to 4, wherein the first sub pre-focus electrode is applied a dynamic voltage and the second sub pre-focus electrode is applied the same voltage as the accelerating electrode.

6. A dynamic four polar electrode system as claimed in one of claims 2 to 4, wherein the pre-focus electrode on the cathode side and the second sub pre-focus electrode are applied a dynamic voltage and the first sub pre-focus electrode is applied a static voltage.

7. A dynamic four polar electrode system as claimed in claim 5, wherein the electron beam pass-through holes in one side of the first sub pre-focus electrode facing the second sub pre-focus electrode are vertically elongated type and the electron beam pass-through holes in the second sub pre-focus electrode are horizontally elongated type or circular type.

8. A dynamic four polar electrode system as claimed in claim 6, wherein the electron beam pass-through holes in one side of the first sub pre-focus electrode facing the second sub pre-focus electrode are horizontally elongated type or circular type and the electron beam pass-through holes in the second sub pre-focus electrode are vertically elongated type.

9. A dynamic four polar electrode system as claimed in claim 2, wherein a third sub pre-focus electrode is further provided between the first and second sub pre-focus electrodes.

10. A dynamic four polar electrode system as claimed in claim 9, wherein the first and second sub pre-focus electrodes are applied the same voltage as the accelerating electrode and the third sub pre-focus electrode is applied a dynamic voltage.

11. A dynamic four polar electrode system as claimed in claim 9, wherein the first and second sub pre-focus electrodes are applied a dynamic voltage and the third sub pre-focus electrode is applied a static voltage.

12. A dynamic four polar electrode system as claimed in claim 10, wherein the electron beam pass-through holes in the first and second sub pre-focus electrodes are horizontally elongated type or circular type and the electron beam pass-through holes in the third sub pre-focus electrode are vertically elongated type.

13. A dynamic four polar electrode system as claimed in claim 11, wherein the electron beam pass-through holes in the first and second sub pre-focus electrodes are vertically elongated type and the electron beam pass-through holes in the third sub pre-focus electrode are horizontally elongated type or circular type.

14. A dynamic four polar electrode system as claimed in one of claims 12 or 13, wherein the vertically elongated electron beam pass-through hole is vertically elongated rectangular type and the horizontally elongated electron beam pass-through hole is horizontally elongated rectangular type.

15. A dynamic four polar electrode system as claimed in one of claims 12 or 13, wherein the vertically elongated electron beam pass-through hole is circular type formed in a vertically elongated recess and the horizontally elongated electron beam pass-through hole is circular type formed in a horizontally elongated rectangular recess.

16. A dynamic four polar electrode system as claimed in claims 15, wherein the recesses in the first and second pre-focus electrodes are disposed to face each other.

17. A dynamic four polar electrode system as claimed in one of claims 12 or 13, wherein the vertically elongated electron beam pass-through hole is a vertically elongated key hole type having a circular hole in the middle of a vertically elongated rectangle and the horizontally elongated electron beam pass-through hole is a horizontally elongated key hole type having a circular hole in the middle of a horizontally elongated rectangle.

18. A dynamic four polar electrode system as claimed in claim 7, wherein the vertically elongated electron beam pass-through hole is vertically elongated rectangular type and the horizontally elongated electron beam pass-through hole is horizontally elongated rectangular type.

19. A dynamic four polar electrode system as claimed in claim 8, wherein the vertically elongated electron beam pass-through hole is vertically elongated rectangular type and the horizontally elongated electron beam pass-through hole is horizontally elongated rectangular type.

20. A dynamic four polar electrode system as claimed in claim 7, wherein the vertically elongated electron beam pass-through hole is circular type formed in a vertically elongated recess and the horizontally elongated electron beam pass-through hole is circular type formed in a horizontally elongated rectangular recess.

21. A dynamic four polar electrode system as claimed in claim 8, wherein the vertically elongated electron beam pass-through hole is circular type formed in a vertically elongated recess and the horizontally elongated electron beam pass-through hole is circular type formed in a horizontally elongated rectangular recess.

22. A dynamic four polar electrode system as claimed in claim 7, wherein the vertically elongated electron beam pass-through hole is a vertically elongated key hole type having a circular hole in the middle of a vertically elongated rectangle and the horizontally elongated electron beam pass-through hole is a horizontally elongated key hole type having a circular hole in the middle of a horizontally elongated rectangle.

23. A dynamic four polar electrode system as claimed in claim 8, wherein the vertically elongated electron beam pass-through hole is a vertically elongated key hole type having a circular hole in the middle of a vertically elongated rectangle and the horizontally elongated electron beam pass-through hole is a horizontally elongated key hole type having a circular hole in the middle of a horizontally elongated rectangle.

* * * * *